US005732414A

United States Patent [19]

Monica

[11] Patent Number: 5,732,414

[45] Date of Patent: Mar. 31, 1998

[54] HELMET HAVING A READILY REMOVABLE AND REPLACEABLE PROTECTIVE LAYER

[75] Inventor: Mark D. Monica, Madison, N.J.

[73] Assignee: Creative Football Concepts, Inc., Madison, N.J.

[21] Appl. No.: 799,511

[22] Filed: Feb. 12, 1997

[51] Int. Cl.[6] ..... A42B 1/08

[52] U.S. Cl. ..... 2/425; 2/412; 2/209.13; 2/46

[58] Field of Search ..... 2/412, 425, 209.13, 2/46

[56] References Cited

U.S. PATENT DOCUMENTS

| | | | |
|---|---|---|---|
| Re. 29,742 | 8/1978 | Tung . | |
| 3,155,981 | 11/1964 | McKissick et al. . | |
| 3,174,155 | 3/1965 | Pitman . | |
| 3,467,964 | 9/1969 | Hannan . | |
| 3,582,990 | 6/1971 | Frieder | 2/412 |
| 3,871,026 | 3/1975 | Dorre . | |
| 3,991,422 | 11/1976 | Saotome . | |
| 4,271,537 | 6/1981 | Bowlus et al. . | |
| 4,599,752 | 7/1986 | Mitchell . | |
| 4,937,888 | 7/1990 | Straus . | |
| 4,993,082 | 2/1991 | Gentes et al. . | |
| 5,226,180 | 7/1993 | Leach | 2/425 |
| 5,525,290 | 6/1996 | Carpenter | 2/425 |
| 5,566,399 | 10/1996 | Cartwright et al. . | |

FOREIGN PATENT DOCUMENTS

| | | |
|---|---|---|
| 2680305 | 2/1993 | France . |
| 3619282A1 | 12/1987 | Germany . |
| 8802114 | 8/1988 | Netherlands . |

OTHER PUBLICATIONS

Automation, Sunnyvale, California Dec. 1996 Brochure.

Alpha Up Corporation, Richardson, Texas Feb. 1996 Brochure.

*Primary Examiner*—Gloria M. Hale

*Attorney, Agent, or Firm*—Lerner, David, Littenberg, Krumholz & Mentlik

[57] ABSTRACT

A helmet having an inexpensive polymeric protective layer for preventing or minimizing gouges, scuff marks, flares and the like to the exterior surface of the helmet is provided. The protective layer may be a post-production item which may be readily removable and replaceable by an unskilled user. The helmet is preferably used during a sporting event, such as football, since the protective layer is effective during practice, scrimmage or official games to protect the helmet's exterior surface at all times.

16 Claims, 2 Drawing Sheets

HELMET HAVING A READILY REMOVABLE AND REPLACEABLE PROTECTIVE LAYER

FIELD OF THE INVENTION

The present invention relates to a helmet having a protective layer for preventing damage to the helmet's exterior surface and more particularly to a helmet having a readily removable and replaceable polymeric protective layer disposed thereon for protecting the helmet's surface from damage.

BACKGROUND OF THE INVENTION

Each year, well over one million people play organized football at the youth, high school, college and professional levels in the United States. Every one of players must wear a football helmet. Persons in many other sports and recreational activities require or recommend that the participants wear a helmet. For example, helmets are worn when playing baseball, hockey, lacrosse, jai alai, skiing and the like or when roller blading, riding bicycles, mopeds or motorcycles.

By way of example, the following discussion is directed toward certain problems associated with football helmets and the like but these same concerns are present with any helmet which may be subject to surface damage. Thus, when reference is made to a football helmet, this is meant to include any helmet susceptible to surface damage.

Helmets are usually reconditioned after each season. During this reconditioning, the helmets are tested, in part, to ensure that they continue to meet the standards set by the National Operating Committee on Standards for Athletic Equipment (the "NOCSAE"). One specific test involves placing a sensor in or on a helmet and thereafter subjecting the helmet to a controlled drop. For instance, a football helmet may be dropped two times from a height of about five feet. During each drop, a computer processes information obtained from the sensor to determine the amount of forces absorbed by the helmet compared to the forces which would be absorbed by a wearer's head. The forces felt by a wearer's head are measured against a standardized reference commonly referred to as a "Severity Index."If a helmet measures 1200 psi on the Severity Index, the helmet must be discarded because the wearer's head is subjected to too much force. If the helmet measures 1199 psi or below, the helmet may be reused.

Several factors may contribute to the degradation of a helmet, i.e., the loss of its ability to sufficiently absorb the forces due to the impact of a collision. One such factor, and probably the most prevalent, is the presence of "stress fractures." Stress fractures typically occur from repeated blows to a helmet. These fractures are usually undetectable by visual inspection and are only discoverable by computer testing. Nevertheless, they will cause a helmet to weaken and thus become less effective at protecting the wearer's head. The stress fracture problem persists in the prior art.

Another problem relates to "scuffing" or "gouging" of prior art helmets. This may occur when two helmets collide and portions of one helmet's hardware (e.g., face mask, fasteners, screws, and the like) scuff and gouge the exterior surface of the other helmet. These gouges also degrade the structural integrity of the helmet. A helmet typically obtains most gouges on the front portion of its exterior surface since this is the area which receives the most contact or impact during use. Certain football helmet manufacturers try to replace helmets that have been in the marketplace for more than ten seasons. However, helmets do not need to be replaced unless they test above the NOCSAE Severity Index of 1200 psi. Thus, if a helmet obtains a certain amount of gouges and stress fractures causing it to fail the NOCSAE test, its overall structure is considered too weak to withstand further damage without injuring a wearer's head. As a result, the helmet must be discarded.

In addition to the excessive gouges and scuff marks reducing the helmet's structural integrity, they also take away from its appearance. Equipment managers spend many long hours repainting helmets or scrubbing off flares (i.e., marks from the color of other helmets), scuff marks, dirt, and the like from the helmets and replacing stripes, logos and the like in preparation for the next game.

In addition to the long hours and hard work expended in repainting and/or repairing the helmets, this maintenance is costly. The youth and high school programs as well as many college programs are mostly concerned with these costs. These groups are not usually well funded and do not usually receive equipment from manufacturers free of charge, as most professional teams do. Therefore, many of these non-professional teams forego aesthetically unattractive and possibly dangerously weak helmets because they cannot afford the necessary maintenance associated with reconditioning of the helmets. Additional reconditioning may be required for aesthetic or structural reasons even when a helmet passes the drop test. For example, the gouges, scuff marks, flares and the like must be sanded and repaired before the helmet can be repainted and reconditioned. Again, these extra steps add to the overall costs of a sports program which some groups may not be able to afford.

Previous attempts have been made to provide a helmet with a protective layer. For example, U.S. Pat. No. 4,993,082 is directed to a method for making a helmet with an ornamented cover. The manufacturing process disclosed in this patent requires the permanent lamination of plastic material onto the exterior surface of the helmet. More particularly, the manufacturing process is directed to a bicycle helmet "having a cover of a thin clear plastic sheet of resilient material molded in the shape of the upper exterior portion of [the]helmet's body and painted or colaminated on the interior of the surface of the cover prior to being fitted and affixed to the helmet's body, thereby giving the cover's decorative design a deep luster, and protecting both the helmet's exterior surface and the cover's decorative appearance."(Specification at Col. 2.) This helmet, however, does not disclose an inexpensive, protective layer which is readily removable and replaceable by an end-user after the helmet has been manufactured. In addition, this reference does not disclose a solution to reducing the type of damage resulting from gouges, scuff marks, flares and the like which occur when playing football or another contact sport or other activity where a person may wear a helmet.

U.S. Pat. No. 3,155,981 is directed to a football helmet and cover mainly for temporary use during practice to distinguish different scrimmage teams by the color of the helmet. The material used to cover the helmet consists of an opaque two-way stretch nylon or other material that is stretchable. The material completely covers the helmet. This cover is secured through a complicated combination of elastic bands and spongy material to prevent slippage. This cover does not appear to be capable of use during an official game because it covers the team's official colors, logos, stripes and the like. That is, it is loosely fitted and completely covers the team's true markings, which normally are exposed to identify each team during a game.

Various other attempts to protect vulnerable surfaces from cracks, nicks, scratches or abrasions using polymeric material are known. Such attempts include protecting automobile headlight and fog light lens, skis and bicycles. For example, one attempt includes an 0.080inch thick film available from Automotion®, of Sunnyvale, Calif. commonly sold as "Headlight Film" or "Foglight Film." This film is used to protect automobile headlight and fog light lens from flying rocks or road debris damage. Automotion® also sells a 0.020 inch thick impact-resistant film that can be cut for lens protection or for front hood or fender protection. However, none of these applications address the problems associated with protecting a helmet's exterior surface.

Accordingly, there is a need for a helmet having a protective layer to minimize damage to the helmet's exterior surface as a result of gouges, scuff marks, flares and the like. There also is a need for a protective layer which is inexpensive and simple to use. This protective layer also should preferably be self-adhesive and readily removable and replaceable such that an unskilled person can easily apply and remove the protective layer on a conventional helmet.

SUMMARY OF THE INVENTION

The present invention overcomes the shortcomings of the prior an by addressing the needs discussed above. One aspect of the present invention comprises a helmet including a helmet body having an interior portion and an exterior portion, wherein the exterior portion includes an exterior surface. Protection means are arranged on the exterior surface of the helmet for protecting it from damage due to contact with another object. The protection means is readily removable and replaceable on the exterior surface by an unskilled user.

In a preferred embodiment of the present invention the protection means is preferably a readily removable and replaceable polymeric protective layer which is disposed on at least a portion of said exterior surface for protecting it from damage caused by contact between said helmet and another object. Preferably the polymeric protective layer comprises vinyl. More preferably, the vinyl is substantially translucent. Even more preferably, the vinyl comprises a thickness of between about 0.005 and 0.050 inches and most preferably comprises a thickness of about 0.012 inches.

In yet a further embodiment, the protective layer comprises at least one main portion having specifically located relief cuts to facilitate the application and placement of the protective layer on the exterior surface.

In still a further embodiment, the protective layer is self-adhesive in that a sufficient coefficient of friction is formed between the exterior surface and the protective layer so that no separate adhesive material is required to secure the protective layer in assembled position on the external surface. In an alternative embodiment, the present invention may include adhesive material arranged between the exterior surface and the protective layer whereby the protective layer is even more tightly fixed in a desired location on the exterior surface. Preferably, the adhesive material is initially applied to one side of the protective layer and then the protective layer is placed on the exterior surface. This arrangement is similar to the construction of single-sided tape. In yet another embodiment, the adhesive materials may not be initially arranged on the protective layer. In such an embodiment, the adhesive material is subsequently applied to the exterior helmet or the protective layer.

In a most preferred embodiment the present invention comprises a football helmet including a helmet body adapted to be worn on a person's head where the helmet body includes an interior portion and an exterior portion having an exterior surface. A readily removable and replaceable polymeric protective layer is disposed on at least a portion of the exterior surface for protecting the exterior surface from damage caused by contact between the football helmet and another object.

BRIEF DESCRIPTION OF THE DRAWINGS

A more complete appreciation of the subject matter of the present invention and the various advantages thereof may be realized by reference to the following detailed description, where reference is made to the accompanying drawings in which.

DETAILED DESCRIPTION OF THE PREFERRED EMBODIMENTS

Figure 1:
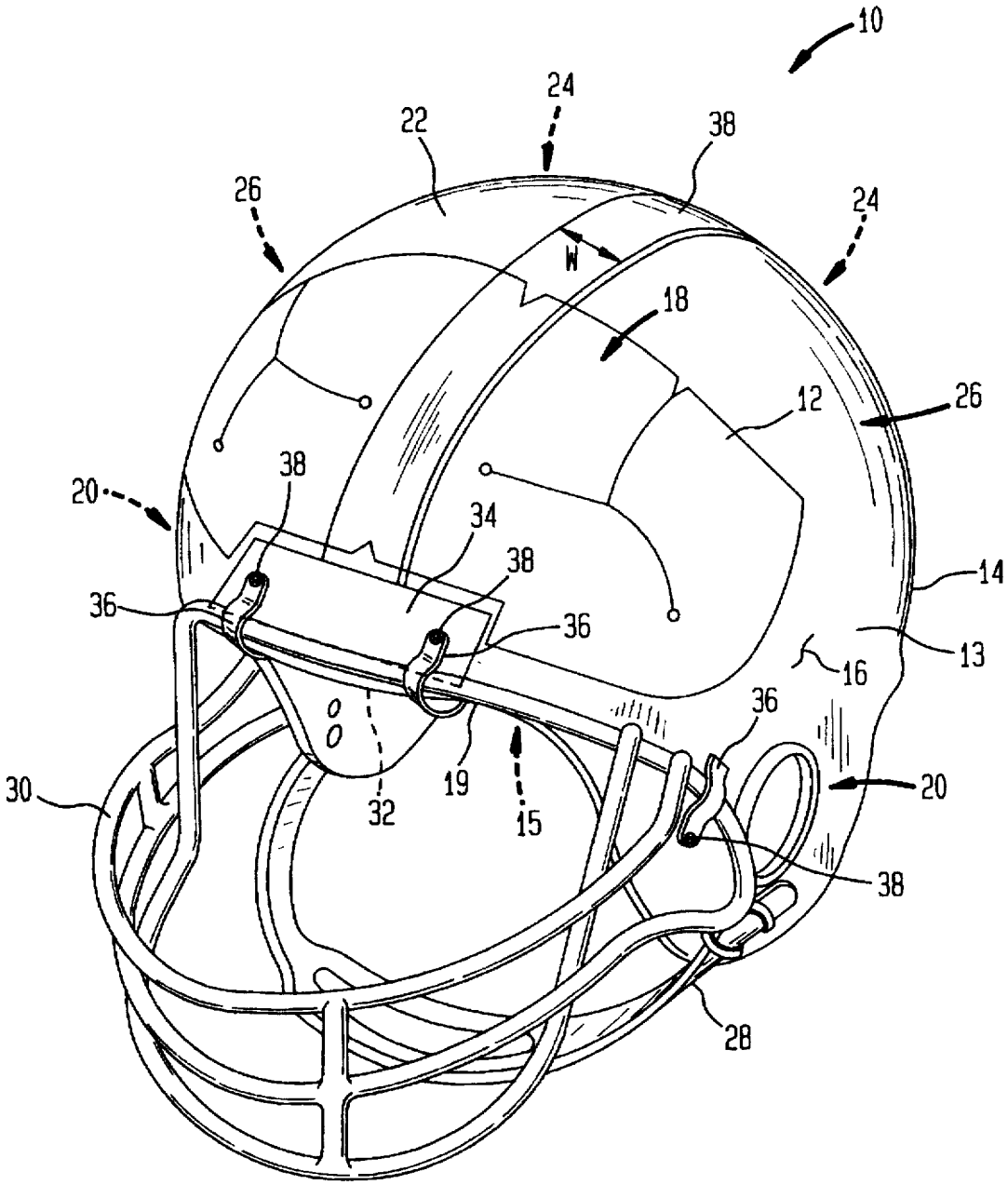
FIG. 1 is a perspective view of a helmet having a protective layer in assembled position in accordance with one embodiment of the present invention.

Referring to FIG. 1, a helmet in accordance with one embodiment of the present invention is generally designated 10. A protective layer 12 is disposed in assembled position on the helmet 10.

In a conventional manner, the helmet 10, which resembles a football helmet available from Riddell® Corporation of Chicago, Ill. includes a main helmet body 14 having a generally spherical shape and adapted to cover and protect a wearer's head. The helmet body 14 includes a cushioned interior portion 15 and a hardened exterior portion 13 including a hardened exterior surface 16. The exterior surface 16 is made of a hardened polymeric material which provides strength to the helmet body 14 and allows for "glancing blows." As used herein, the term "glancing blow" generally means a contact between two helmets where upon impact, the helmets skip off each other before forces are translated directly towards each wearer's helmet, or worse yet, towards their head.

The combination of the hardened exterior portion 13, which allows for glancing blows, and the cushioned interior portion 15, protects a wearer's head upon contact with another "object." As used herein, the term "object" means any mass which may come in contact with the helmet 10 such as another helmet or the hardware associated with such helmet, other protective gear such as shoulder pads, elbow pads and the like, equipment associated with a particular sport or activity such as hockey sticks or lacrosse sticks and the like, goal posts, or the ground.

The helmet body 14 includes a front portion 18 having a front edge 19. The front portion 18 generally covers that area of the helmet body 14 which would surround a wearer's head, including the forehead back to the temples and upward around the top of the wearer's head. The helmet body 14 also includes ear covering portions 20 at opposite sides of the helmet body, a top portion 22, a back portion 24, and side portions 26 on opposite sides of the helmet body 14 above the ear portions 20 and extending upwardly towards the top portion 22 and back around towards the back portion 24. The helmet body 14 further includes an elongated raised portion 38 having a certain width W, integral with the exterior surface 16 and in the center of the helmet body 14 separating the left and right side hemispheres of the helmet body 14. The raised portion 38 extends the full length of the helmet body 14 from the front edge 19 to the furthest end (not shown) of the back portion.

The helmet 10 further includes a chin strap assembly 28 attached on opposite sides of the helmet body 14 just below the ear covering portions 20, and a face guard assembly 30 attached to the helmet body 14 in three places. That is, the face guard assembly 30 is attached above the front edge 19 of the front portion 18 and adjacent each of the ear covering portions 20. The face guard assembly 30 is attached to the helmet body 14 in all three places in a conventional manner such as by way of clamps 36 and screws 38. Finally, the helmet 10 includes a sheath 32 adapted to cover an interior cushion (not shown). The sheath 32 includes an end flap 34 which extends from the cushioned interior portion 15 around the front edge 19 and secured on the front portion 18 in the center of the helmet body 14 over the raised portion 38 and just above the front edge 19. This flap 34 is secured between the exterior surface 16 and the first attachment of the face guard assembly 30.

Figure 2:
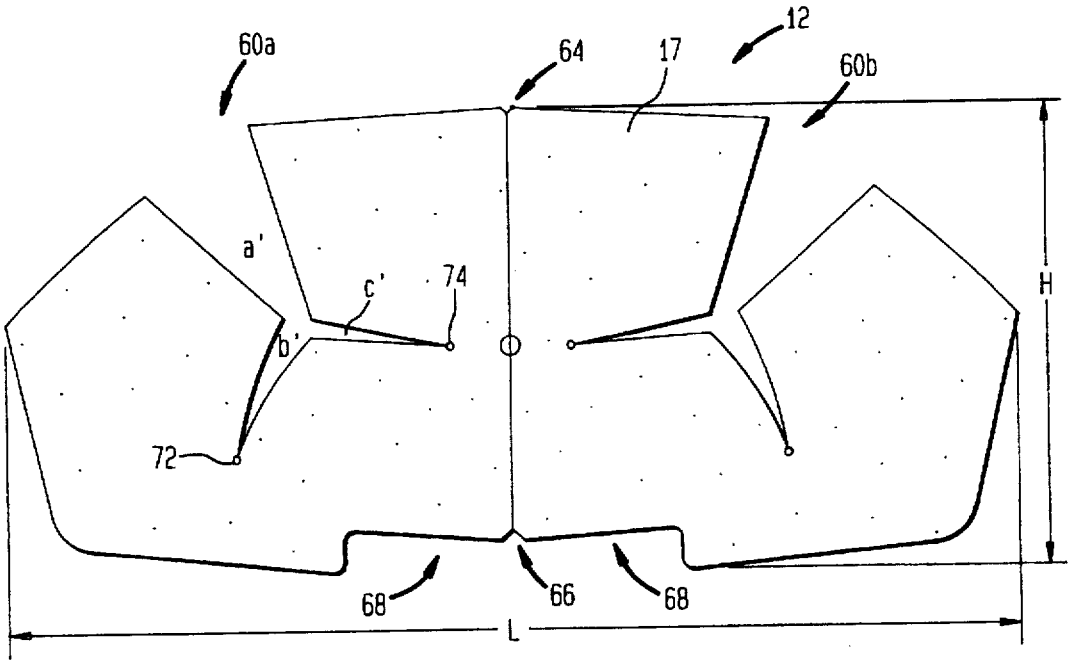
FIG. 2 is an isolated top plan view of the protective layer of FIG. 1 having at least two main portions.

Referring to FIG. 2, the protective layer 12 is shown in an isolated view prior to being applied to the helmet body 14. In this particular embodiment, the protective layer 12 is made from a piece of substantially transparent polymeric material. Various flexible polymeric materials may be used. The protective layer 12 is preferably made of polymeric material such as vinyl and the like. For example, a polymeric material which may be used for practicing the invention is a soft flexible translucent vinyl film coated with a permanent pressure sensitive acrylic adhesive and backed with a two-side poly coated release liner, available from FLEXcon of Spencer, Mass. This particular example of vinyl has a high amount of plasticizer which allows for glancing blows when a helmet collides with another object. However, it should be understood that other materials may be used, with or without additional adhesive, and still be within the scope of the present invention such as, for example, a sprayable polymeric material which after being sprayed on the helmet body 14, some certain time later, it is readily removable.

Use of substantially translucent vinyl having a thickness between about 0.005 to 0.050 inches (i.e., 5 to 50 mil) is preferred. More particularly, a thickness of about 0.012 inch (i.e., 12 mil) is desired for practicing the present invention. However, any thickness of the protective layer 12 which is disposable on the helmet body 14, and thus provide protection, is contemplated by the present invention. The protective layer 12 is substantially translucent so that it does not mask or cover up a team's official or true colors, logos, stripes and the like. That is, the protective layer 12, being substantially translucent and applied in such a manner on the helmet body 14, provides protection to the exterior surface 16 while allowing the helmet's original colors and team designation indicia to show through. Thus, since the protective layer 12 is virtually invisible on the helmet body 14, it can be worn on the helmet body 14 during official games without interfering with a team's identification indicia.

Although the protective layer 12 in this embodiment is made of substantially translucent material, it also may be less translucent or even opaque, and coordinate with a team's true colors and logos. The protective layer 12 also may be less translucent or opaque having colors or designs which do not coordinate with the team's colors, logos, stripes and the like. For example, it may be desirable to use the protective layer 12 as its own separate identifier such as when the same team wishes to have a scrimmage among its players.

It is also preferable for the protective layer 12 to be "self-adhesive." As used herein, the term "self-adhesive" means that the protective layer 12, when applied to the helmet body 14, will adhere to it without the need for additional adhesive. In other words, the inherent coefficient of friction between the polymeric material used for the protective layer 12 and the helmet body 14 is sufficient for the protective layer 12, once applied, to adhere to the helmet body 14 during "normal use," such as where the helmet 10 receives a glancing blow or direct impact from another object.

The protective layer 12 may also be bonded to the helmet body 14 with an additional adhesive 17 such as a pressure sensitive acrylic based adhesive with similar characteristics as that provided on the vinyl available from FLEXcon, as mentioned previously. The adhesive 17 is preferably substantially transparent as well. This additional adhesive 17 may be applied between the protective layer 12 and the helmet body 14 or it may be applied directly to one side of the protective layer 12 prior to application to the helmet body 14, as shown in FIG. 2. The surface of the protective layer 12 has a certain bond strength, whether through self-adhesive or with the additional adhesive 17, such that when the protective layer 12 is disposed on the helmet body 14, it provides a "tight" securement to the helmet body and at the same time provides for a ready removal of the protective layer 12 when so desired by a user. As used herein, the term "tight" means to be disposed on the helmet 10 without, or a minimal amount of, open seams, creases, air bubbles, bumps or gaps in the protective layer 12 so that the protective layer 12 does not become detached from the exterior surface 16 of the helmet body 14 during normal use.

Figure 3:
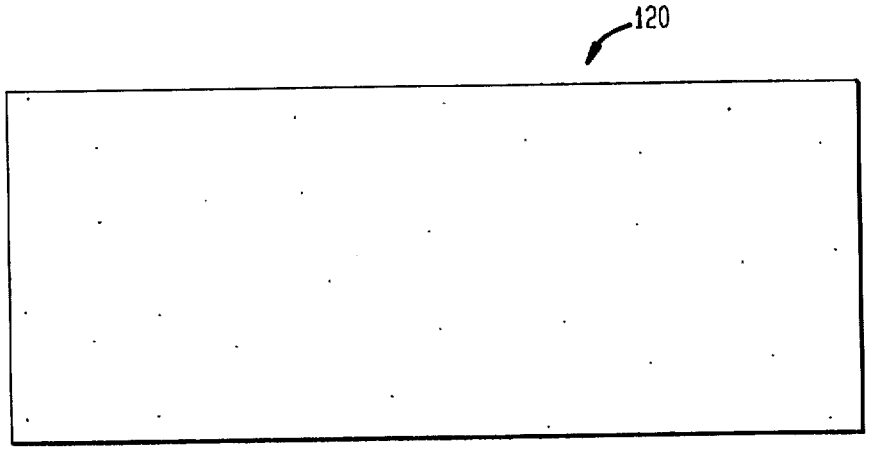
FIG. 3 is another version of the protective layer of FIGS. 1 and 2 having one portion.

The protective layer 12 is generally polygonal in shape but any shape capable of being disposed on a helmet such as the helmet 10 of FIG. 1, which substantially protects the exterior surface 16 from gouges, scuff marks, etc., with the absence of, or a minimal amount of, seams, creases, air bubbles or gaps is contemplated by the present invention. Such shapes include, but are not limited to, squares, rectangles, triangles or irregular shapes having no common geometric configuration. FIG. 3 shows a rectangular version of a self-adhesive protective layer generally designated 120. This protective layer 120 may be disposed anywhere on the helmet body 14 where protection is needed. For instance, it may be placed over a logo which may be on a side portion 26 of the helmet body 14.

In a preferred embodiment, the protective layer 12 may be about 11.5 inches long and about 5.2 inches wide. However, it should be understood that the dimensions of the protective layer 12 may vary considerably in alternative embodiments. The protective layer 12 may include a first main portion 60A and a second main portion 60B which are mirror images of each other having an axis of symmetry about a center line 62. The center line 62 may be the natural fold line or intersection between the two main portions 60A and 60B. The protective layer may also include a first V-shaped notch 64 at one end thereof at the center line 62 and a second relatively larger V-shaped notch 66 on the opposite end of the protective layer at the center line 62. Extending lengthwise in opposite directions from the second V-shaped notch 66 is a recessed area 68 which may measure about 3.5 inches long by 0.5 inches wide, although these dimensions also may vary considerably in alternate embodiments. The recessed area 68 forms a rectangular-shaped notch so that when the protective layer 12 is disposed on the helmet 10 in assembled position, it accommodates the end flap 34 and the center attachment of the face guard 30 without substantially interfering with the end flap 34.

Since main portion 60A is the mirror image of main portion 60B, it is understood that the following description of main portion 60A applies to main portion 60B, except in an opposite but equal manner. Main portion 60A includes three "relief cuts" a', b', and c'generally beginning at the top end of the main portion 60A widthwise and extending almost to the bottom end of main portion widthwise generally in the center of the main portion 60A. As used herein, the term "relief cut" means predetermined slices, slits or cuts made in the protective layer 12 which substantially prevent tears or creases, bumps and the like which may result from placing the two-dimensional protective layer 12 on the three dimensional spherical radius of the helmet body 14. The relief cuts a', b' and c' are located on the main portion 60A such that the protective layer 12, when disposed in assembled position on the helmet body 14, will tightly cover at least the front portion 18 of the helmet body 14, thus, accommodating the three-dimensional spherical radius of the helmet body 14.

In a preferred embodiment of the present invention, the relief cuts a', b' and c' may form arcs having acute angles of 102.2°, 125.1° and 120°, respectively, in relation to each other. In this preferred embodiment, relief cut b' terminates with a ripstop aperture 72 measuring about R0.0623° and relief cut c' terminates with a ripstop aperture 74 measuring about R0.0397°, although these tolerances may vary considerably in alternative embodiments. These ripstop apertures are included to prevent the relief cuts from tearing the protective layer 12 beyond these termination points and to prevent or minimize the amount of creases, bumps, etc., which may result when the protective layer 12 is disposed on the helmet body 14.

In use, the protective layer is easily applied to the front portion 18 of the helmet body 14. Starting at the center of the helmet body, directly above and centered over the raised portion 38, the protective layer 12 is applied such that the recessed area 68 surrounds that portion of the helmet body 14 where the end flap 34 is attached without having the protective layer 12 substantially interfere with the end flap 34. The two main portions 60A and 60B are then tightly secured to the opposing two hemispheres of the helmet body 14 such that the relief cuts a', b' and c' are aligned with each other to prevent creases, spaces, bubbles, bumps and the like.

The protective layer 12 may be easily and readily applied to the helmet body 14 without the need for any special tools. For instance, the protective layer 12 may be applied by an unskilled person using only his or her hands and fingers. Whether the protective layer 12 is applied without the additional adhesive 17 or even with such adhesive 17, the protection layer 12 can be removed as easily as it was applied. This is achieved by reversing the steps as described above. That is, the protective layer 12 is removed by pealing off the outer edges of the main portion 60A, then the main portion 60B, and finally removing the center portions of these main portions which is disposed on the raised portion 38. Thus, an unskilled person may remove the protective layer 12 and replace it with another protective layer 12 or the same protective layer 12, as desired. This can be achieved not only before or after practices or official games but during a practice, scrimmage or even during an official game. It should be understood that removal, re-application and/or replacement of a protective layer 12 may be performed as many times as necessary during a given season to protect the exterior surface 16. It should also be understood that replacement also may only take place once or twice a season. Both of these types of uses and other variations thereof are within the scope and spirit of the present invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit of the present invention as set forth in the appended claims.

What is claimed is:

1. A helmet comprising:

a) a helmet body adapted to be worn on a person's head, said helmet body having an interior portion and an exterior portion, said exterior portion having an exterior surface; and b) a readily removable and replaceable polymeric protective layer which is disposed on at least a portion of said exterior surface for protecting said exterior surface from damage caused by contact between said helmet and another object, said protective layer including at least one main portion having relief cuts thereon to facilitate the application and placement of said protective layer on said exterior surface.

2. The helmet of claim 1 wherein said polymeric protective layer comprises vinyl.

3. The helmet of claim 2 wherein said vinyl is substantially translucent.

4. The helmet of claim 2 wherein said vinyl comprises a thickness of between about 0.005 and 0.050 inches.

5. The helmet of claim 4 wherein said vinyl comprises a thickness of about 0.012 inches.

6. The helmet of claim 1 wherein said protective layer is self-adhesive in that a sufficient coefficient of friction is formed between said exterior surface and said protective layer so that no separate adhesive material is required to tightly secure said protective layer in assembled position on said external surface.

7. The helmet of claim 1 further comprising adhesive material arranged between said exterior surface and said protective layer whereby said protective layer is tightly fixed in a desired location on said exterior surface.

8. The helmet of claim 7 wherein said adhesive material is disposed on one side of said protective layer, wherein said protective layer is tightly disposed on said exterior surface.

9. A football helmet comprising:

a) a helmet body adapted to be worn on a person's head, said helmet body having an interior portion and an exterior portion, said exterior portion having an exterior surface; and b) a readily removable and replaceable polymeric protective layer which is disposed on at least a portion of said exterior surface for protecting said exterior surface from damage caused by contact between said football helmet and another object, said protective layer including at least one main portion having relief cuts thereon to facilitate the application and placement of said protective layer on said exterior surface.

10. The helmet of claim 9 wherein said polymeric protective layer comprises vinyl.

11. The helmet of claim 10 wherein said vinyl is substantially translucent.

12. The helmet of claim 10 wherein said vinyl comprises a thickness of between about 0.005 and 0.050 inches.

13. The helmet of claim 12 wherein said vinyl comprises a thickness of about 0.012 inches.

14. The helmet of claim 9 wherein said protective layer is self-adhesive in that a sufficient coefficient of friction is formed between said exterior surface and said protective layer so that no separate adhesive material is required to tightly secure said protective layer in assembled position on said external surface.

15. The helmet of claim 9 further comprising adhesive material arranged between said exterior surface and said protective layer whereby said protective layer is tightly fixed in a desired location on said exterior surface.

16. The helmet of claim 15 wherein said adhesive material is disposed on one side of said protective layer, wherein said protective layer is tightly disposed on said exterior surface.

* * * * *